US005699761A

United States Patent [19]

Yamaguchi et al.

[11] Patent Number: 5,699,761

[45] Date of Patent: Dec. 23, 1997

[54] TWO-STROKE INTERNAL COMBUSTION ENGINE

[75] Inventors: Shiro Yamaguchi; Masayoshi Miyamoto, both of Tokyo, Japan

[73] Assignee: Kioritz Corporation, Tokyo, Japan

[21] Appl. No.: 806,451

[22] Filed: Feb. 26, 1997

[30] Foreign Application Priority Data

Mar. 1, 1996 [JP] Japan ..... 8-045091

[51] Int. Cl.[6] ..... F02B 33/04

[52] U.S. Cl. ..... 123/73 A; 123/73 PP; 123/65 P

[58] Field of Search ..... 123/73 A, 73 B, 123/73 C, 73 R, 65 P, 73 PP

[56] References Cited

U.S. PATENT DOCUMENTS

| | | | |
|---|---|---|---|
| 3,929,111 | 12/1975 | Turner et al. | 123/73 A |
| 4,178,887 | 12/1979 | Iida | 123/73 A |
| 4,329,948 | 5/1982 | Fujikawa et al. | 123/65 P |
| 4,359,975 | 11/1982 | Heidner | 123/73 R |
| 4,579,093 | 4/1986 | Eanes | 123/69 R |
| 4,590,897 | 5/1986 | Hundertmark | 123/73 A |
| 4,770,132 | 9/1988 | Sougawa | 123/73 A |
| 4,886,021 | 12/1989 | Seeber et al. | 123/73 PP |
| 5,063,887 | 11/1991 | Ozawa et al. | 123/73 C |
| 5,085,180 | 2/1992 | Torigai | 123/73 A |
| 5,251,580 | 10/1993 | Torigai | 123/73 PP |
| 5,284,111 | 2/1994 | Geyer et al. | 123/73 C |
| 5,471,960 | 12/1995 | Nagao et al. | 123/65 P |
| 5,490,483 | 2/1996 | Tanikake et al. | 123/65 P |

FOREIGN PATENT DOCUMENTS

| | | | |
|---|---|---|---|
| 59-173518 | 10/1984 | Japan | 123/65 P |

*Primary Examiner*—David A. Okonsky

*Attorney, Agent, or Firm*—Brumbaugh, Graves, Donohue & Raymond

[57] ABSTRACT

A two-stroke internal combustion engine in a working machine such as a chain saw has been prone to stalling when the stance of the machine was changed from slanting down to slanting up. Such stalling is minimized when lower longitudinal scavenging passage in the cylinder block of the engine have smaller cross section as compared with upper scavenging passage, and when the crank chamber of the engine includes a flow restricting portion for impeding the flow of liquid fuel into the lower scavenging passage when the stance is changed. The engine has a cylinder block (12), a crankcase (20), scavenging passages (27, 27), and a flow restricting portion (40) on an inner peripheral surface (22*a*) of the crank chamber (22).

5 Claims, 3 Drawing Sheets

TWO-STROKE INTERNAL COMBUSTION ENGINE

BACKGROUND OF THE INVENTION

1. Field of the Invention

The present invention relates to a two-stroke internal combustion engine, and more particularly to a two-stroke internal combustion engine which is preferably used for a portable working machine such as a chain saw in which an operator uses it while changing his or her working stance.

2. Description of the Prior Art

Conventionally, in a portable power working machine such as a chain saw in which an operator uses it while changing his or her working stance, as a driving source for the working machine, a small-scale air-cooled two-stroke gasoline engine (hereinafter referred to as "two-stroke internal combustion engine" or simply "engine") has been widely used. The two-stroke internal combustion engine has a vertical length (in a direction in which a piston reciprocates in a cylinder block) which is longer than its horizontal length. In a small chain saw, the engine is generally disposed and accommodated in a main housing.

An engine which is disposed and accommodated in a main housing is disclosed, for example, in Japanese Utility Model Laid-Open Specification 140402/1981. In the engine disclosed in this publication, there is an opening at the bottom (the front end portion of the machine) of a crank chamber, serving as an air-fuel mixture suction opening for air-fuel mixture from a carburetor to the crank chamber through a lead valve. The air-fuel mixture is precompressed to be introduced into a combustion chamber through scavenging passages which are in communication with the crank chamber and are disposed vertically along the cylinder block.

In using a working machine with an engine such as a chain saw, there is a concern with sudden engine stoppage when the working machine first is operated while a front portion thereof (working portion) is directed downward or diagonally downward for a period of time, and then the front portion is directed upward or diagonally upward.

This is due to the fact that while the front portion of the working machine is directed downward or diagonally downward, the air-fuel mixture suction opening, which is in communication with the crank chamber of the engine, is directed downward or diagonally downward, and liquid fuel which is not properly atomized adheres to the inner peripheral surface and the like of the crank chamber and flows down to the air-fuel mixture suction opening and remains there. When the front end portion of the working machine then is turned upward, the liquid fuel flows into the scavenging passage along the inner peripheral surface of the crank chamber and rushes into the combustion chamber from the scavenging passage, making the air-fuel mixture too rich for burning. Thus, a decrease in engine speed or stoppage of the engine is caused by an undesirable flow of liquid fuel due to a change in the stance of the engine in accordance with the change in the stance of the working machine.

The present applicant has already disclosed means for preventing the undesired flow of liquid fuel due to the change in stance of the engine in Japanese Patent Application No. 313371/1995.

In the disclosed two-stroke internal combustion engine, with a crank chamber and an air-fuel mixture suction opening communicating with the crank chamber in a crank case, a flow restricting portion with a convex portion or the like is provided on the inner peripheral surface of the crank chamber and in the vicinity of the air-fuel mixture suction opening to restrict the liquid fuel from flowing downward on the inner peripheral surface of the crank chamber when the front portion of the working machine is directed upward and to reduce the velocity of the flow. This flow restricting portion prevents the liquid fuel from rushing into the combustion chamber along the inner wall of the crank chamber, which avoids drawbacks such as engine stoppage.

In this kind of two-stroke internal combustion engine, however, scavenging passages with the same shape are horizontally symmetrically mounted on the inner surface of the cylinder of the engine, and the air-fuel mixture flows injected from scavenging parts of the scavenging passages to the combustion chamber are directed so as to collide with each other. As a result, swirl flow in the combustion chamber is impeded, and even with the above-mentioned flow restricting portion on the inner peripheral surface of the crank chamber temporarily to hold the liquid flow, when the liquid fuel flows into the combustion chamber of the cylinder, the liquid fuel may not sufficiently be mixed with air, thus restricting combustion in the combustion chamber.

Further, when the front portion of the working machine is directed downward, the liquid fuel may remain on the inner peripheral surface of the crank chamber next to the flow restricting portion on the side of the cylinder of the flow restricting portion such as the convex portion. When the front portion of the working machine then is directed upward, there is a concern with the liquid fuel flowing downward along the inner peripheral surface of the crank chamber so as to enter the combustion chamber.

SUMMARY OF THE INVENTION

The present invention has been made in consideration of the above-mentioned problems, and the object thereof is to provide a two-stroke internal combustion engine in which even if the stance of the engine is changed in accordance with a change in the stance of the working machine, the liquid fuel adhering to the inner peripheral surface and the like of the crank chamber would not be susceptible to flow undesirably, thus preventing the liquid fuel from rushing into the combustion chamber. And even if a portion of the fuel were to flow into the combustion chamber as liquid, operation of the engine would not be impaired.

To accomplish the above-mentioned object, a two-stroke internal combustion engine according to the present invention comprises a cylinder block; a crankcase; a crank chamber formed by the cylinder block and the crankcase; scavenging passages vertically disposed along the cylinder block at each of symmetrical portions with respect to a lateral cross-section which divides an exhaust passage into two, with cross sections of the scavenging passages being different from each other; and a flow restricting portion for liquid fuel on an inner peripheral surface of the crank chamber on the side of the scavenging passages with smaller cross sections at lower portions of the cylinder block.

More particularly, in the two-stroke internal combustion engine according to the present invention with the above-mentioned construction, the cross sections of the upper and lower scavenging passages may be different from each due to different channel depth of the scavenging passages, and the flow restricting portion can be a concave dam portion.

Further, still more particularly, the concave dam portion may comprise: a flat surface formed along the overall width of the crank chamber, extending from the inner peripheral surface of the crank chamber toward the scavenging passages with smaller cross sections; a concave surface extending from the flat surface; and an acute contact portion formed by the concave surface and channel bottom portions of the scavenging passages.

Still further, a two-stroke internal combustion engine according to the present invention can be characterized in that an inner surface, on the side of the flow restricting portion, of an air-fuel mixture suction opening which is in communication with the scavenging passages is formed along a tangential line of the inner peripheral surface of the crank chamber.

In the two-stroke internal combustion engine according to the present invention with the above-mentioned construction, even if liquid fuel remaining at the air-fuel mixture suction opening of the crank chamber tries to flow into the combustion chamber along the inner peripheral surface of the crank chamber due to the change in stance of the engine, a concave dam-shaped flow restricting portion for the liquid fuel, formed in the vicinity of the inlet of the scavenging passage on the inner peripheral surface of the crank chamber, hinders the flow of the liquid fuel and decreases its velocity considerably.

Further, the lower scavenging passages with the flow restricting portion are formed to have shallow channel depths and small passage cross sections in comparison with the upper scavenging passages, for high velocity of the passing air-fuel mixture. When the air-fuel mixture is injected from the upper and lower scavenging passages into the combustion chamber, there is a difference in velocity of the air-fuel mixture injected from each of the upper and lower scavenging passages. This difference causes a swirl in the combustion chamber, efficaciously causing the air-fuel mixture to rotate and resulting in improved combustion.

Further, in case that the liquid fuel which temporarily remains in the flow restricting portion flows into the scavenging passages after it crosses over the acute portion of the dam portion, the liquid fuel is turned into fine particles by the acute portion, and a swirl flow of the air-fuel mixture is generated in the combustion chamber. Thus, there is rapid agitation and mixing with air-fuel mixture for proper combustion.

BRIEF DESCRIPTION OF THE DRAWINGS

The present invention will be more apparent from the description with reference to the accompanying drawings wherein.

DETAILED DESCRIPTION OF PREFERRED EMBODIMENTS

Figure 1:
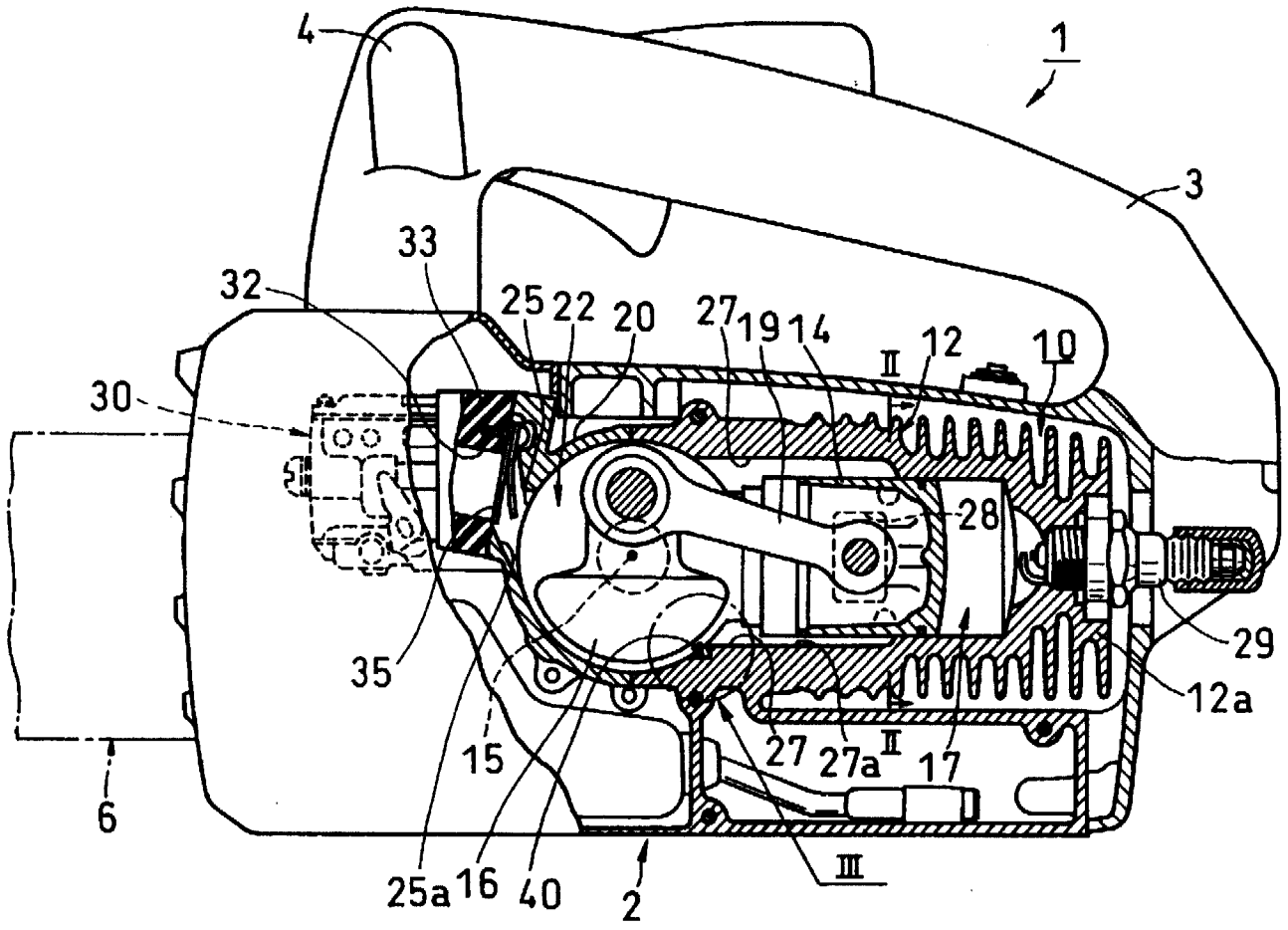
FIG. 1 is a partially fragmented view of a chain saw with a two-stroke internal combustion engine according to an embodiment of the present invention.

FIG. 1 shows a chain saw 1 with a two-stroke internal combustion engine according to an embodiment of the present invention.

The chain saw 1 in FIG. 1 is provided with a main housing 2. To the front portion of the main housing 2 there is detachably mounted a working portion 6 comprising a saw chain. To the upper portion of the main housing 2 there is attached a main handle 3. To the left side portion of the front portion thereof there is attached the upper end portion of a loop-shaped auxiliary handle 4.

In the main housing 2, a two-stroke internal combustion engine 10 according to this embodiment is disposed in such that a cylinder head 12*a* of a cylinder block 12 to which an ignition plug 29 is attached is directed rearward, that is, the cylinder block 12 is positioned on the rear side, and a crankcase 20 connected thereto is situated on the front side.

In the cylinder block 12, the piston 14 is inserted so as to reciprocate. In the cylinder block 12 on the top surface side of the piston 14, there is formed a combustion chamber 17. The spark plug 29 is attached to the top portion of the cylinder block 12 so as to oppose the combustion chamber 17.

The reciprocating movement of the piston 14 is converted to rotational movement of a crank shaft 15 which is supported by bearings (not shown) attached so as to be positioned between a semicylindrical crankcase 20 and the lower portion of the cylinder block 12 through a connecting rod 19. In accordance with the rotation of the crank shaft 15, a balance weight 16 attached thereto rotates in a crank chamber 22 which is formed by the crankcase 20 and the lower portion of the cylinder block 12.

At a slightly upper portion of the bottom portion (the front portion when lying) of the crank chamber 22 in the crankcase 20, there is an opening serving as an air-fuel mixture suction opening 25. Air-fuel mixture which flows out from a diaphragm carburetor 30 through a supply passage 32 formed in an insulator 33 is sucked from the air-fuel mixture suction opening 25 to the crank chamber 22 through a lead valve 35 and is precompressed therein. The air-fuel mixture is introduced into the combustion chamber 17 through the upper and lower scavenging passages 27, 27 on the cylinder block 12.

Figure 2:
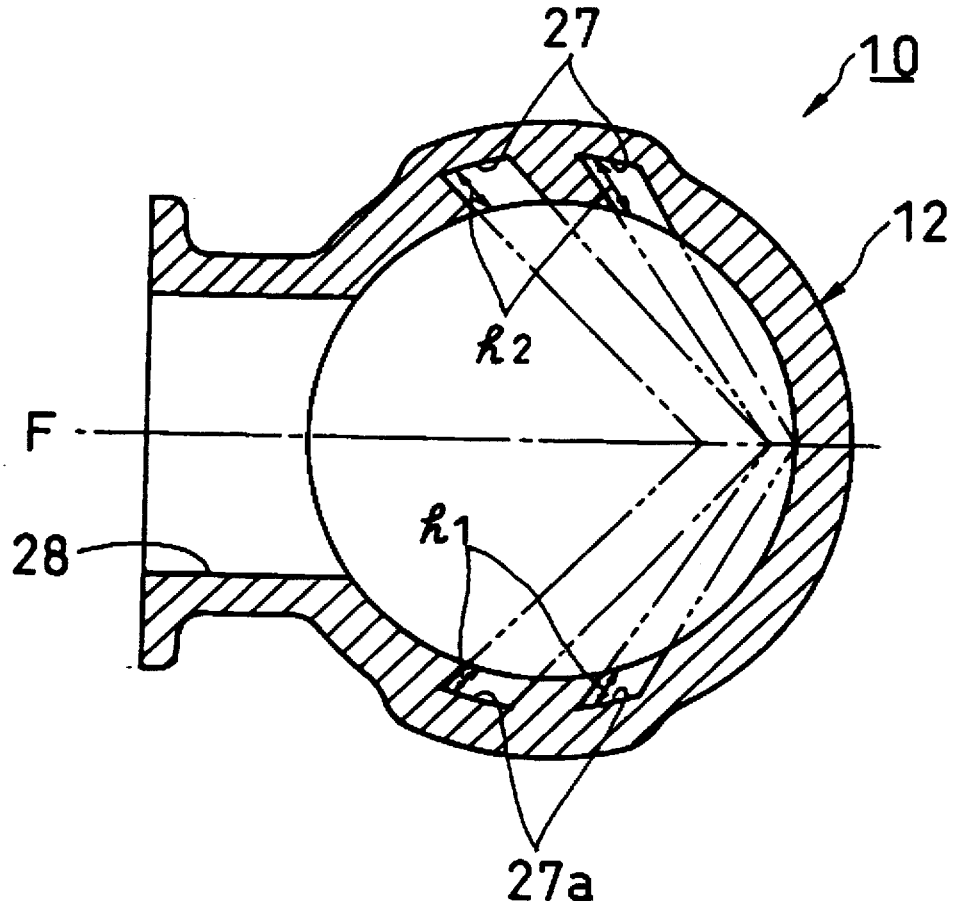
FIG. 2 is an enlarged cross-sectional view taken along the line II—II of FIG. 1 with the piston of the two-stroke internal combustion engine removed.

In this embodiment, as illustrated in FIG. 2, the cylinder block 12 is provided with a pair of open channel-shaped scavenging passages 27, 27 vertically along the cylinder block 12 at each of symmetrical portions with respect to a lateral cross-section F which divides an exhaust port 28 into two and which passes through the center line of the cylinder block 12. The depths of the channels of the scavenging passages 27, 27 at the upper portion and the lower portion are different from each other as illustrated in FIG. 2. The channel depth ($h_1$) of the lower scavenging passage 27 (lower one away from the main handle 3 in FIG. 1) is shallow, and the channel depth ($h_2$) of the upper scavenging passage 27 (upper one adjacent to the main handle 3 in FIG. 1) is deeper. Symmetrically corresponding upper and lower scavenging passages 27, 27 have the same width but different depths, so that their cross sections are different from each other. Thus, when the air-fuel mixture passes through the upper and lower scavenging passages 27, 27, flow velocities differ, and the air-fuel mixture is injected into the combustion chamber 17 with different velocities from the different scavenging passages 27, 27.

Figure 3:
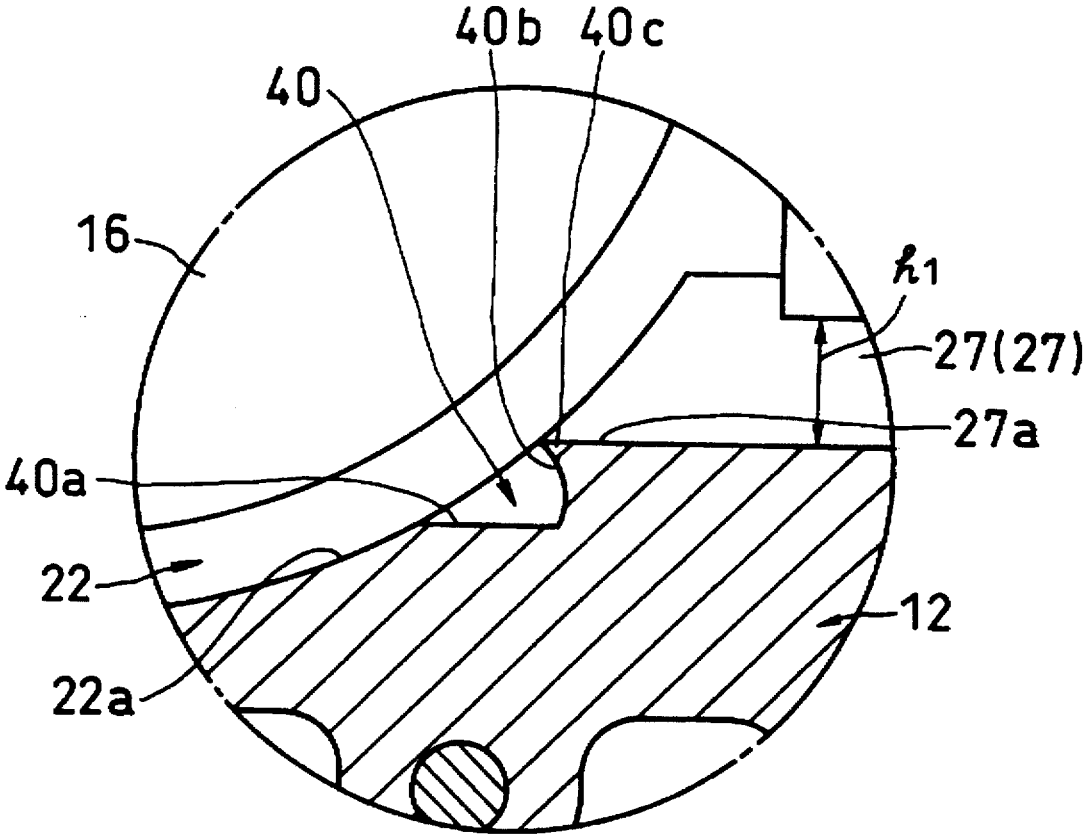
FIG. 3 is an enlarged view of a portion of the two-stroke internal combustion engine which is enclosed by a circle III in FIG. 1.

As indicated in FIG. 3, on the inner peripheral surface 22*a* of the crank chamber 22 at inlet portions of the scavenging passage 27 with shallow channel depth ($h_1$), there is provided a dam portion 40 as a liquid flow restricting portion. The dam portion 40 extends across the overall width of the crank chamber 22 along the crank shaft 15, and it temporarily stores the liquid fuel held in the crank chamber 22. The dam portion 40 is formed concave, and on the side at which the liquid fuel flows in, it is formed as a flat surface 40*a* extending from the inner peripheral surface 22*a* so that the liquid fuel easily flows in from the inner peripheral surface 22*a*. The outflow side (inlet side of the scavenging passage 27) of the dam portion 40 is formed to hold the liquid fuel therein, as a concave surface 40*b* extending from the flat surface 40*a*. The channel bottom 27*a* of the lower scavenging passage 27 is disposed so as to be in contact with the outflow end of the concave surface 40*b*. A connecting portion 40*c* of the outflow end of the concave surface 40*b* and the channel bottom 27*a* is formed acute. With the construction of the concave dam portion 40 described above, the liquid fuel is securely stored in the dam portion 40 and is supplied to the combustion chamber 17 after being blown into fine particles by the air-fuel mixture stored in the crank chamber 22.

Further, in this embodiment, the air-fuel mixture suction opening 25 is formed to have an inclined inner surface 25*a*, which is an inclined lower portion of the lower portion of a free end of the lead valve 35, such that no liquid fuel is held around the lead valve 35, and the air-fuel mixture suction opening 25 is formed along an tangential line of the inner peripheral surface 22*a* of the crank chamber 22 to guide the air-fuel mixture including the liquid fuel toward the lower portion of the crank chamber 22.

Next, the working of the chain saw 1 with the engine 10 according to the above embodiment of the present invention with the aforementioned construction will be explained. After work is carried out with the front portion of the chain saw 1 directed downward or diagonally downward for a period of time, liquid fuel adhering to the inner peripheral surface 22*a* of the crank chamber 22 and the like flows along the inner peripheral surface 22*a* and is guided to the air-fuel mixture suction opening to be held therein.

Then, when the front portion of the chain saw 1 is directed upward or diagonally upward, the liquid fuel held at the air-fuel mixture suction opening 25 flows along the inner peripheral surface 22*a* of the crank chamber 22 and is guided to the dam portion 40, which hinders the flow of the liquid fuel and decreases its velocity.

Thus, liquid fuel is prevented from rushing into the combustion chamber 17 along the inner peripheral surface 22*a* of the crank chamber 22. As a result, the engine 10 keeps running smoothly.

Further, in the embodiment, the lower scavenging passage 27 with the dam portion 40 are formed to have shallow channel depth $h_1$ and small passage cross section in comparison with the upper scavenging passage 27, so that the velocity of the passing air-fuel mixture is high. The air-fuel mixture is injected from the upper and lower scavenging passages 27, 27 into the combustion chamber 17 with different velocities. This difference causes a swirl in the combustion chamber 17, efficaciously causing the air-fuel mixture to rotate and resulting in improved combustion.

Further, when the liquid fuel which temporarily remains in the dam portion 40 flows into the lower scavenging passage 27 after it crosses over the connecting portion 40*c* of the dam portion 40 to be atomized and injected into the combustion chamber 17, a swirl flow of the air-fuel mixture is generated in the combustion chamber 17, so that there is rapid agitation and mixing with air-fuel mixture for proper combustion.

A test was carried out using a chain saw with a two-stroke internal combustion engine with a displacement of 28 cc according to the present embodiment, at temperatures to −10° C. and at an elevation of 1000 m while changing the stance of the engine. No significant decrease in engine speed or stoppage was observed.

Under the above conditions, the engine idled satisfactorily at 600 rpm, i.e. at a speed significantly lower than the conventional 1,000 rpm.

Further, in a power performance test of the two-stroke internal combustion engine according to this embodiment, even though the shape of the scavenging passage is changed and a convex dam portion is formed on the inner peripheral surface of the crank chamber of the cylinder block there was no less of power as compared with a conventional engine.

One embodiment of the present invention has been explained above in detail, however, it is to be understood that the present invention is not to be limited to the above-mentioned embodiment and many modifications can be made in design without departing from the spirit of the present invention claimed.

For example, in the above embodiment, the concave dam portion 40 is formed as a flow restricting portion. However, the shape of the flow restricting potion is not so limited as other means for storing liquid fuel, e.g., dam portions, channels and concave portions with different constructions from that described in the above embodiment can be used.

Further, in the aforementioned embodiment, the depths $h_1$ and $h_2$ of the scavenging passages 27, 27 are different from each other. Instead, it is possible to change the widths thereof, as different cross sections of the upper and lower scavenging passages 27, 27 can be realized in various ways.

As understood from the above explanation, the two-stroke internal combustion engine according to the present invention is provided with a flow restricting portion such as a concave dam portion in the vicinity of an inlet of a scavenging passage on the inner peripheral surface of a crank chamber, so that liquid fuel which would rush into the combustion chamber due to a change in engine stance, is hindered by the flow restricting portion and is prevented from rushing into the combustion chamber, thus preventing unintentional engine stoppage and the like.

Further, the cross sections of the scavenging passage with the flow restricting portion are designed to be smaller than those of the other scavenging passage, so that air-fuel mixture is injected with different velocities from scavenging passages, thus promoting a swirl stream in the combustion chamber efficaciously to rotate the air-fuel mixture for improved combustion.

What is claimed is:

1. A two-stroke internal combustion engine comprising:

a crank chamber (22) formed by a cylinder block (12) and a crankcase (20) attached to the cylinder block;

an air-fuel mixture suction opening (25) in communication with the crank chamber for admitting air-fuel mixture to the crank chamber;

an exhaust port (28) formed on the cylinder block;

upper and lower scavenging passages (27, 27) formed at an interior wall of the cylinder block in a longitudinal direction of the cylinder block and symmetrical with respect to a lateral cross section (F) through the exhaust port, with the lower scavenging passage having lesser cross section as compared with the upper scavenging passage; and a flow restricting portion (40) disposed on an inner peripheral surface (22*a*) of the crank chamber for restricting liquid fuel flow from the crank chamber into the lower scavenging passage.

2. The two-stroke internal combustion engine according to claim 1, wherein the lower scavenging passage is formed less deep than the upper scavenging passage.

3. The two-stroke internal combustion engine according to claim 1, wherein the flow restricting portion comprises a concave dam portion (40).

4. The two-stroke internal combustion engine according to claim 3, wherein the concave dam portion comprise:

a flat surface (40*a*) formed across the crank chamber so as to extend from an inner peripheral surface portion (22*a*) of the crank chamber toward the lower scavenging passage;

a concave surface (40*b*) extending from the flat surface; and an acute contact portion (40*c*) formed by the concave surface and a channel bottom portion (27*a*) of the lower scavenging passage.

5. The two-stroke internal combustion engine according to claim 1, wherein the air-fuel mixture suction opening has an inner surface portion (25*a*) which is tangential to the inner peripheral surface portion of the crank chamber.

* * * * *